US007370612B2

(12) United States Patent
Hanai

(10) Patent No.: US 7,370,612 B2
(45) Date of Patent: May 13, 2008

(54) INTERNAL COMBUSTION ENGINE COOLING SYSTEM

(75) Inventor: Shuichi Hanai, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 0 days.

(21) Appl. No.: 11/566,895

(22) Filed: Dec. 5, 2006

(65) Prior Publication Data

US 2007/0137592 A1 Jun. 21, 2007

(30) Foreign Application Priority Data

Dec. 20, 2005 (JP) ..... 2005-366022

(51) Int. Cl.
*F01P 11/02* (2006.01)
*F01P 7/16* (2006.01)

(52) U.S. Cl. ..... 123/41.14; 123/41.55; 123/41.05

(58) Field of Classification Search ..... 123/41.14, 123/41.01, 41.05, 41.55; 237/12.3 B
See application file for complete search history.

(56) References Cited

U.S. PATENT DOCUMENTS 3,498,539 A * 3/1970 Winkman et al. ..... 237/12.3 R
6,032,869 A * 3/2000 Ito et al. ..... 237/12.3 B
6,446,586 B2 * 9/2002 Fukamachi ..... 123/41.1
2004/0123816 A1 * 7/2004 Batzill et al. ..... 123/41.1

FOREIGN PATENT DOCUMENTS

| | | |
|---|---|---|
| JP | 2003-184553 | 7/2003 |
| JP | 2004-232567 | 8/2004 |
| JP | 2005-146950 | 6/2005 |

* cited by examiner

*Primary Examiner*—Stephen K. Cronin
*Assistant Examiner*—Ka Chun Leung
(74) *Attorney, Agent, or Firm*—Oblon, Spivak, McClelland, Maier & Neustadt, P.C.

(57) ABSTRACT

A check valve having a thermostat function is provided between an engine and a thermal storage tank that stores a portion of the coolant circulating in the engine. The check valve restricts the flow of the coolant from the engine to the thermal storage tank, and loosens the restriction when the temperature of the coolant increases. Through such operation of the check valve, the warm coolant is collected in the thermal storage tank and engine preheating may be performed before engine start. Thus, by providing between the engine and the thermal storage tank the check valve that operates in response to the temperature of the coolant, engine preheating can be accomplished with a simple structure and at a low cost, without using a three-way valve and performing an electrical valve switching control.

16 Claims, 8 Drawing Sheets

PREHEATING PERIOD (BEFORE ENGINE START)

AFTER ENGINE WARM-UP (COLLECTION OF WARM COOLANT)

INTERNAL COMBUSTION ENGINE COOLING SYSTEM

INCORPORATION BY REFERENCE

The disclosure of Japanese Patent Application No. 2005-366022 filed on Dec. 20, 2005 including the specification, drawings and abstract is incorporated herein by reference in its entirety.

BACKGROUND OF THE INVENTION

1. Field of the Invention

The invention relates to an internal combustion engine cooling system of.

2. Description of the Related Art

In an internal combustion engine (hereinafter, also referred to as an engine) installed in a vehicle or the like, it is important to warm up the engine as quickly as possible after the engine is started to improve fuel economy and reduce exhaust emissions.

Conventionally, to quickly warm-up a water-cooled engine, a cooling system stores part of the coolant that has been warmed during the operation of an internal combustion engine and keeps the stored coolant warm. The warm coolant may be stored in a thermal storage tank and used to preheat (pre-warm) the engine before the next engine start (see Japanese Patent Application Publication No. JP-A-2003-184553 and Japanese Patent Application Publication No. JP-A-2005-146950, for example).

FIG. 8 shows one example of a conventional cooling system that preheats an engine.

The cooling system shown in FIG. 8 includes a cooling circuit 301 for cooling a cylinder block 201*a* and a cylinder head 201*b* of an engine 201 using coolant; a heater circuit 302 for heating the passenger compartment and some components and devices using coolant that has absorbed heat from the engine (hereinafter "warm coolant"); and a thermal storage circuit 303 for storing the warm coolant until the next engine start.

The cooling circuit 301 includes a mechanical water pump (W/P) 202 driven by the engine 201; a radiator 203 that cools the coolant; and a thermostat 204 that adjusts the flow rate of the coolant flowing into the engine 201 after flowing through the radiator 203. The thermostat 204 adjusts, by changing the opening amount of the valve, the flow rate of the coolant that flows in the cooling circuit 301 while passing through the radiator 203 and the flow rate of the coolant that flows in the cooling circuit 301 without flowing through the radiator 203. The heater circuit 302 is provided with a heater core 205.

The thermal storage circuit 303 is provided with a thermal storage tank 207 that stores warm coolant that has flown into the thermal storage circuit 303, and an electrically driven water pump (W/P) 208. The discharge port of the electrically driven water pump 208 is connected to the thermal storage tank 207.

The cooling system is provided with a three-way valve 206 that selectively connects and disconnects the three circuits, i.e., the cooling circuit 301, the heater circuit 302, and the thermal storage circuit 303. The three-way valve 206 has three ports. A first port P1 is connected to the inlet port of the mechanical water pump 202, a second port P2 to the heater core 205, and a third port P3 to the inlet port of the electrically driven water pump 208.

In the above-described cooling system, when preheating the engine before starting it, the electrically driven water pump 208 is driven with the first port P1 and the third port P3 of the three-way valve 206 open and the second port P2 closed, to supply the warm coolant from the thermal storage tank 207 to the cylinder block 201*a* and the cylinder head 201*b* of the engine 1.

Next, while the engine 201 is being warmed up (i.e., while the engine is operating at a low temperature), the ports P1 to P3 of the three-way valve 206 are all closed, so that coolant is circulated to the cylinder block 201*a* and the cylinder head 201*b* of the engine 201 through the cooling circuit 301 by the mechanical water pump 202. Further, it is possible to supply the warm coolant to the heater core 205 by opening the first port P1 and the second port P2 of the three-way valve 206 during the operation of the engine 1.

Then, by opening the first port P1 and the third port P3 of the three-way valve 206 while the engine 201 is operating after it has been warmed-up, a part of the warm coolant in the cylinder block 201*a* of the engine 201 is collected and stored in the thermal storage tank 207. The stored warm coolant is utilized to preheat the engine before the next engine start.

Further, in the case of a system as shown in FIG. 8 in which a three-way valve is used, a positioning sensor such as a potentiometer needs to be provided along with the three-way valve, therefore the production cost is high. Also, in a cooling system including a three-way valve, it is necessary to control the switching of the three-way valve based on particular conditions of the engine operation such as the engine being not operating (before engine start), the engine being presently warmed up, and the warming-up of the engine having been completed, which requires a complicated control system.

SUMMARY OF THE INVENTION

It is an object of the invention to provide an internal combustion engine cooling system having a simple and low-cost structure that enables the internal combustion engine to be preheated before engine start.

A first aspect of the invention relates to a cooling device that includes: a thermal storage device that stores a portion of the coolant circulating in an internal combustion engine; and a valve device, provided between the thermal storage device and the internal combustion engine, that controls the flow of the coolant. The valve device restricts the flow of the coolant from the internal combustion engine to the thermal storage device, and loosens the restriction on the flow of the coolant in response to an increase in the temperature of the coolant. For example, the valve device may be a check valve that restricts the flow of the coolant from the internal combustion engine to the thermal storage device and loosens the restriction in response to an increase in temperature of the coolant.

Based on the above description, firstly, when the engine is being warmed up (when the engine is operating at a low temperature) after the engine has been started, the flow of the coolant from the internal combustion engine to the thermal storage device is restricted by the valve device, so that the coolant circulates only in a cooling circuit for cooling the engine. When the temperature of the coolant increases to a certain level after the engine is warmed up, the restriction on the flow of the coolant imposed by the valve device is loosened. Thus, portion of the coolant (warm coolant) that has been warmed in the internal combustion engine passes through the valve device, after which it is collected in the thermal storage device and stored therein. Subsequently, when the operation of the internal combustion engine is stopped and the temperature of the coolant decreases to a certain level, the flow of the coolant is restricted by the valve device, so that the coolant does not flow into the thermal storage device from the internal combustion engine. Then, before the operation of the internal combustion engine is started next time, the coolant (warm coolant) stored in the thermal storage device is fed by pressure toward the internal combustion engine against, for example, the elastic force of a compression coil spring of the check valve, that is, the coolant (warm coolant) stored in the thermal storage device is supplied to the internal combustion engine to preheat the internal combustion engine.

As described above, according to the first aspect of the invention, the collection of the coolant (warm coolant) in the thermal storage device and the preheating before the start of the internal combustion engine may be performed by the valve device that operates in response to the temperature of the coolant, without performing an electrical valve switching control. As such, engine preheating can be performed at a lower cost than the case where a three-way valve is used.

As one example of the valve device, a check valve that includes a temperature-sensing portion and serves also as a thermostat and may be employed. The check valve loosens the restriction on the flow of the coolant in response to an increase in temperature of the coolant.

To effectively transmit an increase and a decrease in temperature of the coolant to the temperature-sensing portion provided in the valve device that serves as a thermostat when the coolant flow is restricted by the valve device, the temperature-sensing portion of the valve device may be placed in contact with the coolant from the internal combustion engine, by allowing a leak of the coolant in the valve device and thereby generating a flow of the coolant in the valve device. Alternatively, to place the temperature-sensing portion in contact with the coolant from the internal combustion engine, a pipe may be provided that communicates with a flow passage in which the temperature-sensing portion is arranged, so that the coolant flows through the pipe during the restriction on the flow.

The temperature-sensing portion of the valve device may be placed in direct contact with the coolant flowing in the internal combustion engine, by disposing the valve device to be in contact with a main body (for example, the cylinder block, or the cylinder head) of the internal combustion engine. With this arrangement, because the valve device is attached to the main body of the internal combustion engine, heat is directly transmitted to the temperature-sensing portion from the main body of the internal combustion engine. That is, the temperature-sensing portion can more efficiently detect an increase and a decrease in the temperature of the coolant, without providing an additional path of the coolant leading to the temperature-sensing portion of the valve device. In addition, the structure for installing the valve device is simplified. It is to be noted that the valve device may be either incorporated in the main body of the internal combustion engine, or disposed outside thereof, as long as the valve device is in contact with the main body of the internal combustion engine.

Examples of the temperature-sensing portion of the valve device include, for example, a thermowax that expands and contracts according to an increase and a decrease in the temperature of the coolant, or a bimetal and a shape-memory alloy (or shape-memory resin) that changes form in accordance with the temperature of the coolant, and so on.

According to the invention, the valve device that controls the flow of the coolant in response to the temperature of the coolant is provided between the internal combustion engine and the thermal storage device that stores a portion of the coolant circulating in the internal combustion engine. By the operation of the valve device, the collection of the coolant (warm coolant) in the thermal storage tank and the preheating before the start of the engine can be performed. Thus, engine preheating can be achieved with a simple structure and at a low cost, without using a three-way valve and performing electrical valve switching control.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein.

DETAILED DESCRIPTION OF THE EXEMPLARY EMBODIMENTS

Hereinafter, exemplary embodiments of the invention will be described with reference to the accompanying drawings.

Figure 1:
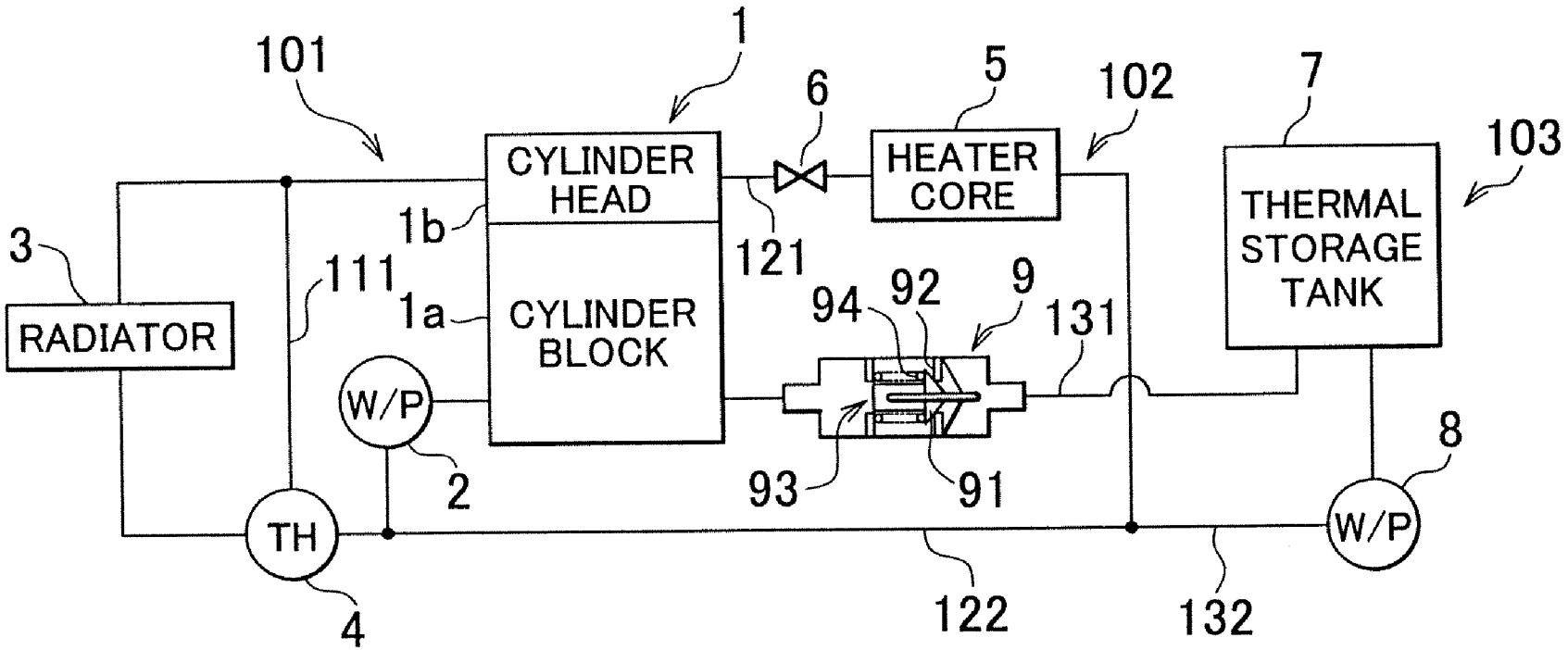
FIG. 1 is a circuit diagram illustrating one example of a cooling system according to the invention.

FIG. 1 shows a circuit diagram of an exemplary embodiment of the cooling system according to the invention.

The cooling system of this embodiment includes a cooling circuit 101, a heater circuit 102, and a thermal storage circuit 103. The cooling circuit 101 cools a cylinder block 1*a* and a cylinder head 1*b* of an engine 1 using coolant. The heater circuit 102 heats a passenger compartment using warm coolant (warm coolant). The thermal storage circuit 103 stores a part of the coolant (warm coolant) in a thermal storage tank 7 while keeping it warm.

The cooling circuit 101 is provided with a mechanical water pump (W/P) 2, a radiator 3, a thermostat 4, etc. The mechanical water pump (W/P) 2 is driven by the engine 1 to circulate the coolant in the cooling circuit 101. The radiator 3 cools the coolant. The thermostat 4 adjusts the flow rate of the coolant that flows into the engine 1 after passing through the radiator 3. The mechanical water pump 2 is arranged such that the discharge port thereof is connected in communication to the cylinder block 1*a* of the engine 1. The thermostat 4 is, for example, a valve device operated by the expansion and contraction of a thermowax provided in a temperature-sensing portion of the thermostat 4. When the temperature of the coolant increases, the thermostat 4 increases the flow rate of the coolant supplied to the radiator 3, to lower the temperature of the coolant that is taken into the engine 1. On the other hand, when the temperature of the coolant decreases, the thermostat 4 interrupts the flow of the coolant to the radiator 3, thereby increasing the flow rate of the coolant flowing through a bypass passage 111 and thus increasing the temperature of the coolant that is taken into the engine 1.

The heater circuit 102 includes a heater core 5 used to heat the passenger compartment. A coolant supply pipe 121 that supplies the coolant to the heater circuit 102 is connected to the cylinder head 1*b* of the engine 1. The coolant supply pipe 121 is provided with a two-way valve 6. A return pipe 122 of the heater circuit 102 is connected to the inlet port of the mechanical water pump 2 of the cooling circuit 101.

The thermal storage circuit 103 includes an electrically driven water pump (W/P) 8 powered by a battery, and the thermal storage tank 7 that stores the coolant that has flowed into the thermal storage circuit 103 and keeps the stored coolant warm. The thermal storage tank 7 is connected to the cylinder block 1*a* of the engine 1 via a connecting pipe 131. The electrically driven pump 8 is arranged such that the discharge port thereof is connected in communication to the thermal storage tank 7. A pipe 132 is provided on the side of the inlet port of the electrically driven water pump 8 in the thermal storage circuit 103 and is connected to the aforementioned return pipe 122 in the heater circuit 102.

A check valve 9 having a thermostat function is provided in the connecting pipe 131 that connects the thermal storage tank 7 and the cylinder block 1*a*. The check valve 9 restricts (interrupts) the flow of the coolant from the cylinder block 1*a* to the thermal tank 7 when the coolant is at a low temperature, and loosens the restriction on the flow of the coolant by displacing a valve body 91 in response to an increase in the temperature of the coolant in contact with a temperature-sensing portion 93, to be described later.

Figure 2:
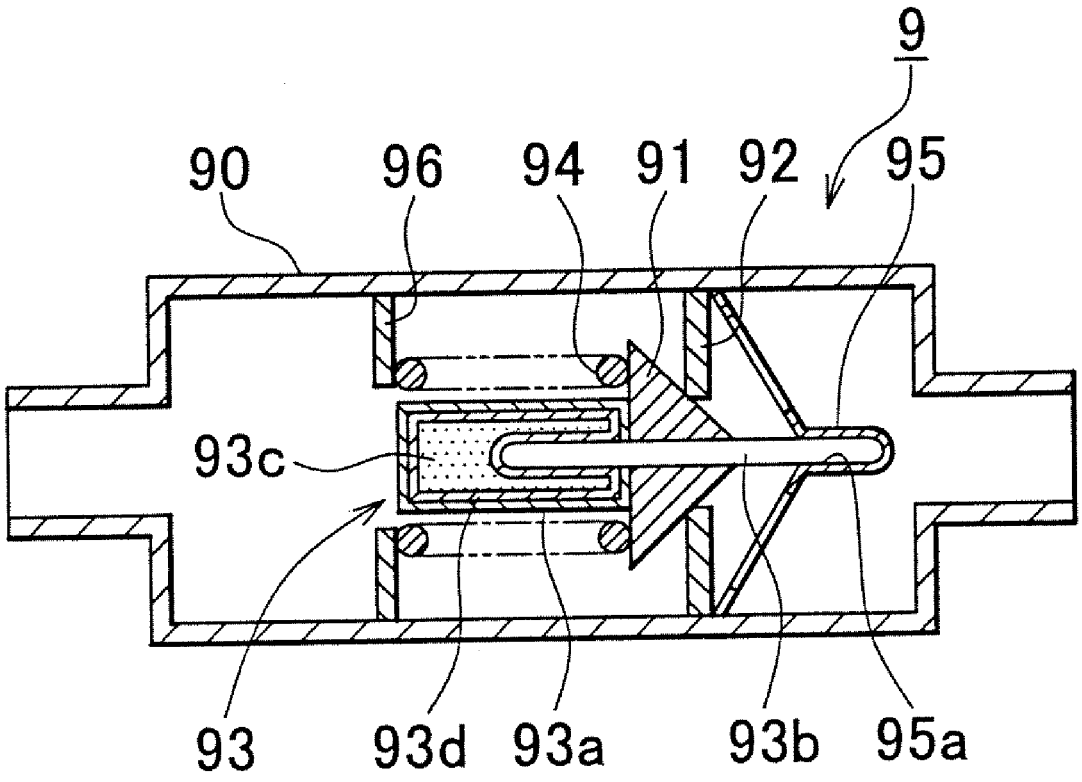
FIG. 2 is a vertical sectional view showing the structure of a check valve, which also serves as a thermostat, used in the cooling system shown in FIG. 1.

Hereinafter, the structure of the check valve 9 will be described in detail with reference to FIG. 2.

The check valve 9 includes the valve body 91, a valve seat plate 92, the temperature-sensing portion 93, a compression coil spring 94, a rod-holding member 95, a spring support plate 96, and a housing 90.

In the housing 90, the valve seat plate 92 that has a through hole having a round cross section at the center thereof and the spring support plate 96 are arranged to face each other. Further, in the housing 90, the rod-holding member 95 is disposed on the surface of the valve seat plate 92 at the side opposite where the valve body 91 is provided. The valve seat plate 92, the rod-holding member 95, and the spring support plate 96 are all fixed to the housing 90. The rod-holding member 95 and the spring support plate 96 are each formed in a shape that does not interfere with the flow of the coolant.

The valve body 91 has a conical shape and is disposed such that the vertex of the valve body 91 faces the valve seat plate 92. The valve body 91 and the case 93*a* of the temperature-sensing portion 93 are integral with each other. The compression coil spring 94 is interposed between the valve body 91 and the spring support plate 96. The valve body 91 is urged toward the valve plate 92 by the elastic force of the compression coil spring 94.

The temperature-sensing portion 93 includes the case 93*a* that is cylindrical in shape and a piston rod 93*b*. One side of the piston rod 93*b* is slidably disposed in the case 93*a* and the other side of the piston rod 93*b* is slidably inserted into a holding hole 95*a* of the rod holding member 95. The case 93*a* is filled with a thermowax 93*c* that expands and contracts in accordance with the temperature of the coolant. As the thermowax 93*c* expands and contracts, the distance that the piston rod 93*b* protrudes from the case 93*a* changes. Note that the thermowax 93*c* is provided in a sealing member 93*d* made of rubber or the like.

In the check valve 9 structured as described above, as the temperature of the coolant that is in contact with the temperature-sensing portion 93 increases and the thermowax 93*c* expands in response to the temperature increase, the protruding distance of the piston rod 93*b* from the case 93*a* increases. As a result, the temperature-sensing portion 93 and the valve body 91, which are integral with each other, are displaced away from the valve seat plate 92 against the elastic force of the compression coil spring 94, so that the valve body 91 moves away from the valve seat plate 92 (see FIG. 5). If the temperature of the coolant decreases and the thermowax 93*c* thereby contracts from this state, the protruding distance of the piston rod 93*b* from the case 93*a* decreases, so that the elastic force of the compression coil spring 94 pushes the valve body 91 back to the valve seat plate 92.

When the temperature of the coolant in contact with the temperature-sensing portion 93 is low, the check valve 9 restricts the flow of the coolant to the thermal storage tank 7. On the other hand, as the temperature of the coolant increases and the valve body 91 is thereby displaced, the restriction on the flow of the coolant to the thermal storage tank 7 is loosened, allowing the coolant to flow from the cylinder block 1*a* to the thermal storage tank 7.

It should be noted that the temperature of the coolant (i.e., the coolant contacting the temperature-sensing portion 93) at which the valve body 91 starts to be displaced is set lower than the temperature at which the thermostat 4 in the cooling circuit 101 switches to allow the coolant to flow to the radiator 3. For example, if the switching temperature of the thermostat 4 is set to 88° C., the temperature at which the check valve 9 starts to open is set to 80° C.

Next, operations of the above-described cooling device (i.e., operation during engine preheating, operation during engine warm-up, and operation after engine warm-up (collection of warm coolant)) will be explained with reference to FIGS. 1 to 5.

During Preheating

Figure 3:
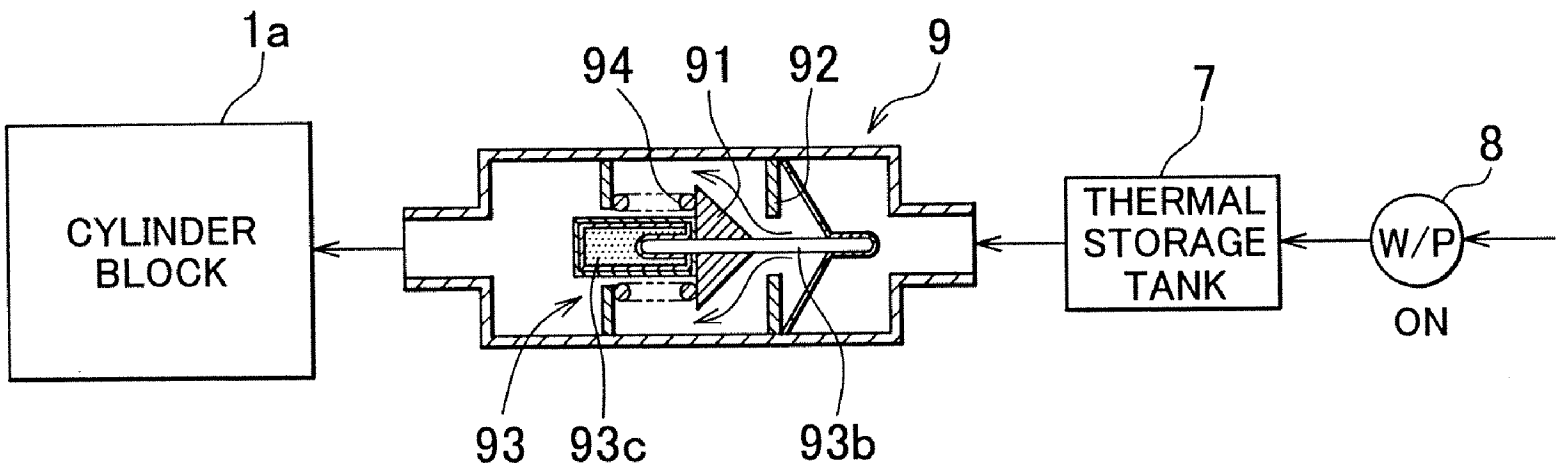
FIG. 3 is a diagram showing the operation of the cooling system shown in FIG. 1 during the preheating period.

The electrically driven water pump 8 is driven (turned ON) during engine preheating that is performed before engine start, as shown in FIG. 3. Driving the electrically driven water pump 8 causes the warm coolant, which was collected in the thermal storage tank 7 during the last engine operation, to flow into the check valve 9. The pressure (i.e., the discharge pressure of the electrically driven pump 8) of the warm coolant that has flown into the check valve 9 pushes the valve body 91 and the entire temperature-sensing portion 93 (including the piston rod 93*b*) to open the check valve 9 against the elastic force of the compression coil spring 94, which establishes a coolant path in which the coolant circulates in the following order: the electrically driven water pump 8→the thermal storage tank 7→the check valve 9→the engine 1 (cylinder block 1*a*)→the mechanical water pump 2→the electrically driven water pump 8. The warm coolant stored in the thermal storage tank 7 is thus supplied to the cylinder block 1*a* and used to preheat the engine 1. As a result of the preheating, the content of the thermal storage tank 7 is replaced by the cold coolant from the engine 1.

It should be noted that the time period during which the electrically driven water pump 8 operates may be set to a time period necessary for the cold coolant in the engine 1 to be replaced by the warm coolant supplied from the thermal storage tank 7. The length of this time period is determined so as not to allow the cold coolant circulated by the electrically driven water pump 8 to return to the engine 1.

Because the engine 1 is warmed up by the warm coolant stored in the thermal storage tank 7 in this manner, it is possible to quickly increase the volatility of fuel and thus improve the ignitability of air-fuel mixtures, which ensures good startability, for example, when starting the engine at a low temperature. As such, it is possible to improve fuel efficiency and reduce exhaust emissions.

During Warming-Up of Engine

Figure 4:
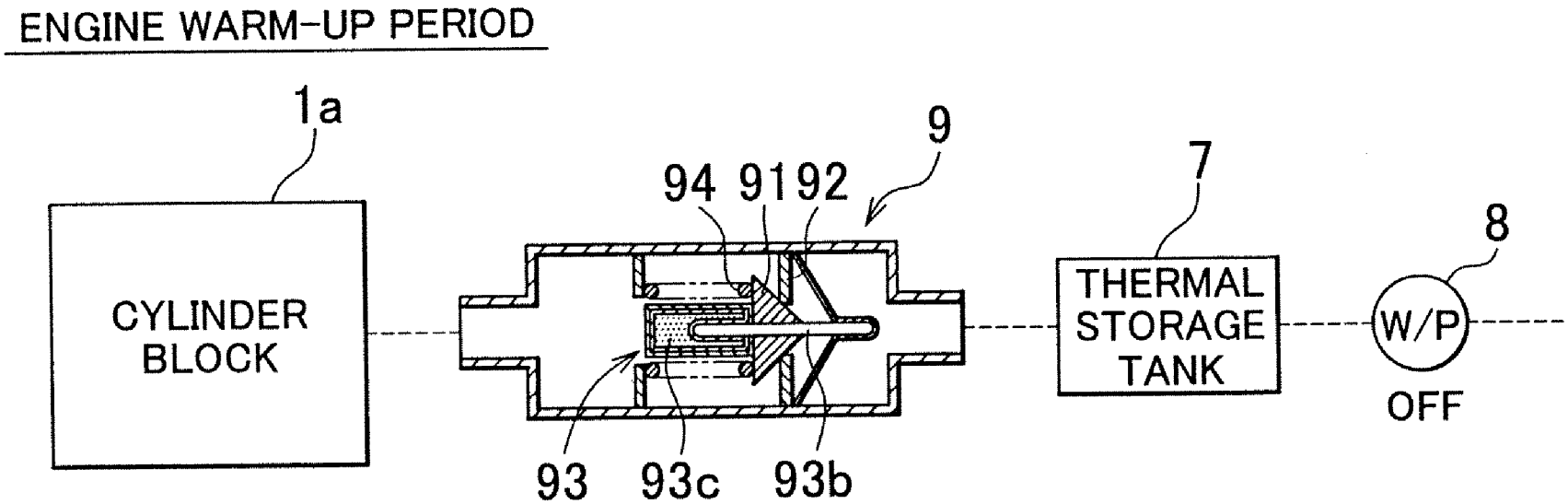
FIG. 4 is a diagram showing the operation of the cooling system shown in FIG. 1 during the warm-up period of an engine.

After the aforementioned preheating is completed (the electrically driven water pump 8 is turned OFF), the engine 1 is warmed up for some time after the engine 1 is started. During the warming-up of the engine 1, as shown in FIGS. 1 and 4, the flow of coolant from the cylinder block 1*a* to the thermal storage tank 7 is restricted (interrupted) by the check valve 9, so that coolant is circulated only in the cooling circuit 101 by the mechanical water pump 2. During this circulation, the coolant is heated by the cylinder block 1*a* and the cylinder head 1*b* of the engine 1, so that the temperature of the coolant increases.

As described above, when the engine 1 is being warmed up, the check valve 9 restricts the flow of coolant from the cylinder block 1*a* to the thermal storage tank 7. Therefore, the cold coolant that has been stored in the thermal storage tank 7 as a result of the preheating does not enter the engine 1 side, which makes the warming-up more effective.

After Engine Warm-Up (Collection of Warm Coolant)

Figure 5:
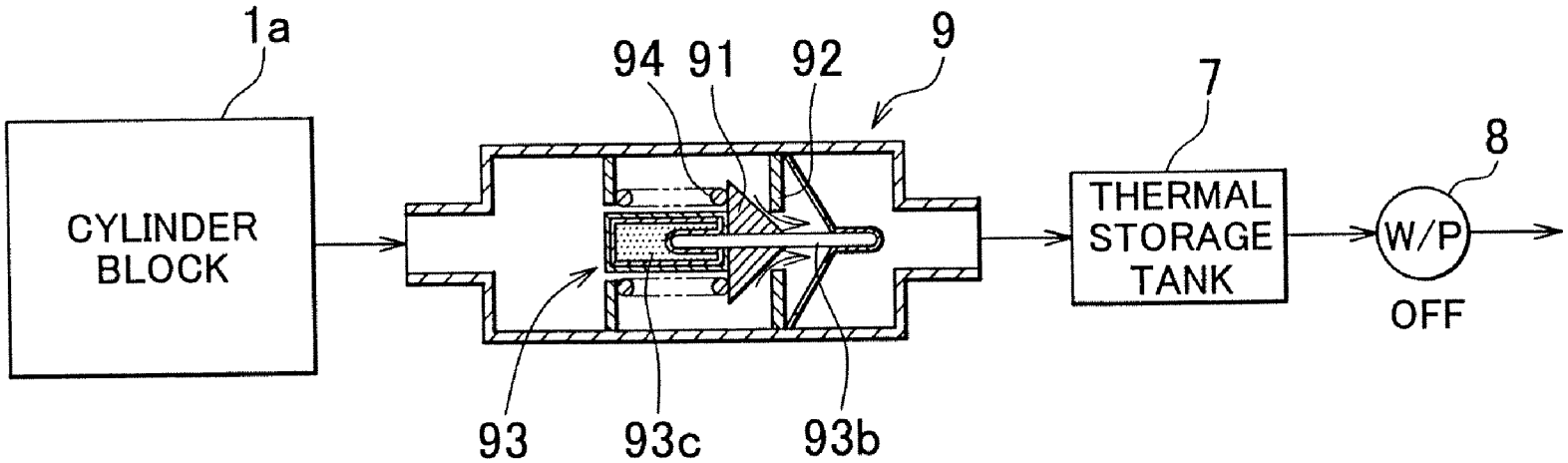
FIG. 5 is a diagram showing the operation of the cooling system shown in FIG. 1 after the warm-up of the engine.

After the engine is warmed-up, the temperature of the coolant increases to a predetermined threshold temperature (e.g., 80° C. or more). At the threshold temperature, the thermowax 93*c* in the temperature-sensing portion 93 of the check valve 9 expands, whereby the piston rod 93*b* further protrudes (moves forward) from the case 93*a*, whereby the valve body 91 moves away from the valve seat plate 92 as shown in FIG. 5. This operation of the check valve 9 establishes, in addition to the cooling circuit 101, a coolant path through which the coolant circulates in the following order: the mechanical water pump 2→the cylinder block 1*a*→the check valve 9→the thermal storage tank 7→the electrically driven water pump 8→the mechanical water pump 2. Thus, a part of the warm coolant circulating in the cooling circuit 101 is supplied from the cylinder block 1*a* to the thermal storage tank 7 and stored therein. The warm coolant thus collected is utilized to preheat the engine 1 before the next engine start. Note that, when heating the passenger compartment, the warm coolant may be supplied to the heater core 5 by opening the two-way valve 6 in the heater circuit 102 after the engine 1 has been warmed up (or when the engine 1 is being warmed up).

Subsequently, if the operation of the engine 1 is stopped and the temperature of the coolant in contact with the temperature-sensing portion 93 of the check valve 9 decreases to a certain level (e.g., 80° C. or less), the piston rod 93*b* of the temperature-sensing portion 93 moves backward, so that the valve body 91 returns to the valve seat plate 92 due to the elastic force of the compression coil spring 94. Accordingly, when the engine is not operating, the cold coolant does not flow from the cylinder block 1*a* to the thermal storage tank 7, and therefore the warm coolant is stored and kept warm in the thermal storage tank 7.

As described above, according to the cooling device of the embodiment, because a check valve 9 that operates in response to the temperature of the coolant is used to collect warm coolant into the thermal storage tank 7 and preheat the engine 1 before engine starts. Accordingly, preheating of the engine 1 can be accomplished with a simple structure and at a low cost.

If a check valve that dose not have a thermostat function (hereinafter referred to as a "simple check valve") is provided between the cylinder block 1*a* of the engine 1 and the thermal storage tank 7, in order to collect warm coolant in the thermal storage tank 7 during the operation of the engine 1, an electrically-driven water pump having a high capacity needs to be used as the water pump 8 so that it can overcome the discharge pressure of the mechanical water pump 2 (and the elastic force of the compression coil spring 94) and displace the valve body 91. On the contrary, in the above-described structure employed in the embodiment, the collection of warm coolant in the thermal storage tank 7 is performed by the check valve 9 reducing, using its thermostat function, the function of restricting the coolant flow after the warming-up of the engine 1. Thus, warm coolant can be collected in the thermal storage tank 7 during the operation of the engine 1 without using the electrically driven water pump 8.

According to the embodiment having the foregoing structure, therefore, it is possible to use, as the electrically-driven water pump 8, a compact electrically-driven water pump that is capable of feeding warm coolant from the thermal storage tank 7 to the cylinder block 1*a* by pressure against the elastic force of the compression coil spring 94 of the check valve 9, and therefore to suppress the consumption of the battery power by the electrically-driven water pump 8.

OTHER EMBODIMENTS

In the structure shown in FIG. 1, when there is a difference between the increase in temperature of the coolant on the side of the cylinder block 1*a* and the increase in temperature of the coolant in contact with the temperature-sensing portion 93 of the check valve 9 due to, for example, a longer distance between the cylinder block 1*a* of the engine 1 and the check valve 9, the check valve 9 may not respond rapidly enough when the temperature of the coolant is increased to a certain level (e.g., 80° C. or more) by the engine warming-up. Structures for avoiding this will be described with reference to FIGS. 6A, 6B, and FIGS. 7A, 7B.

Figure 6A:
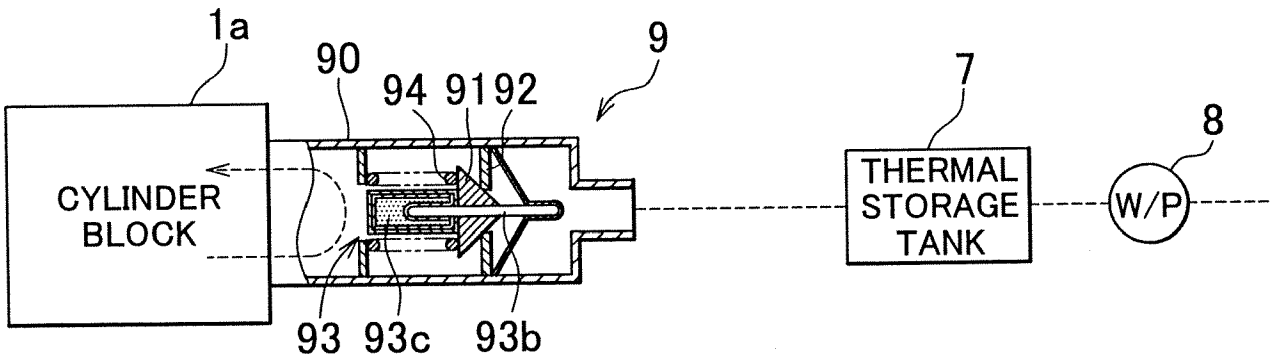
FIG. 6A and FIG. 6B are diagrams showing other embodiments of the cooling system according to the invention.

In the structure shown in FIG. 6A, the housing 90 of the check valve 9 is directly attached to the cylinder block 1*a* of the engine 1 (i.e., the main body of an internal combustion engine), so that a part of the coolant circulating through a water jacket in the cylinder block 1*a* flows into the housing 90 of the check valve 9. Thus, the temperature-sensing portion 93 directly detects the temperature of the coolant flowing through the cylinder block 1*a*. According to this structure, because the temperature of the coolant in the cylinder block 1*a* is directly detected, it is possible to improve the response of the check valve 9 to changes in the coolant temperature, and this improvement can be accomplished with a simple structure, without providing an additional coolant path to the temperature-sensing portion 93 of the check valve 9. Note that, although the check valve 9 is attached to the outside of the cylinder block 1*a* in the embodiment of FIG. 6A, the check valve 9 may alternatively be incorporated in the main body of the engine 1.

Figure 6B:
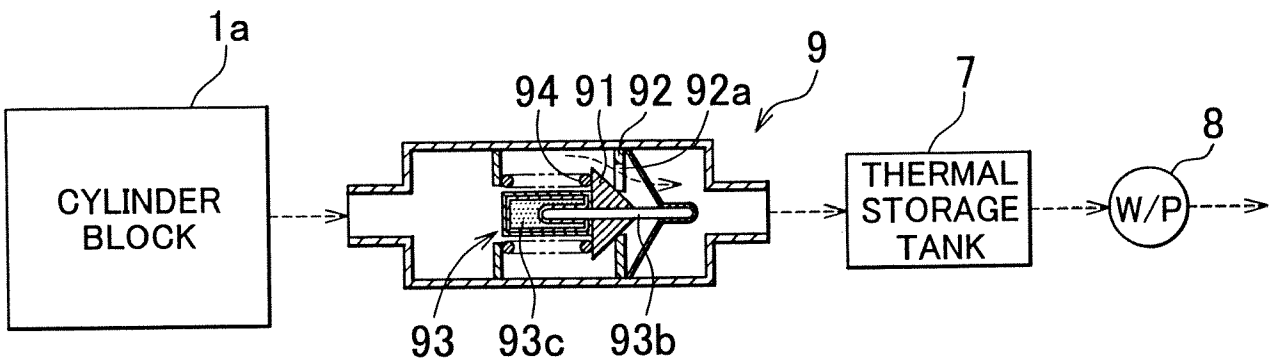

In the structure shown in FIG. 6B, a notch 92*a* is provided in the valve seat plate 92 of the check valve 9, which allows a portion of the coolant to be leaked to the thermal storage tank 7 side. In this structure, a certain amount of the leaked coolant flows in the following order: the cylinder block 1*a*→the periphery of the temperature-sensing portion 93 in the check valve 9→the notch 92*a*→the thermal storage tank 7. Thus, the temperature-sensing portion 93 can contact the coolant flowing from the cylinder block 1*a*. Note that, instead of the notch 92*a*, a through hole may be formed through the valve seat plate 92 to allow a portion of the coolant to leak to the thermal storage tank 7 side.

Figure 7A:
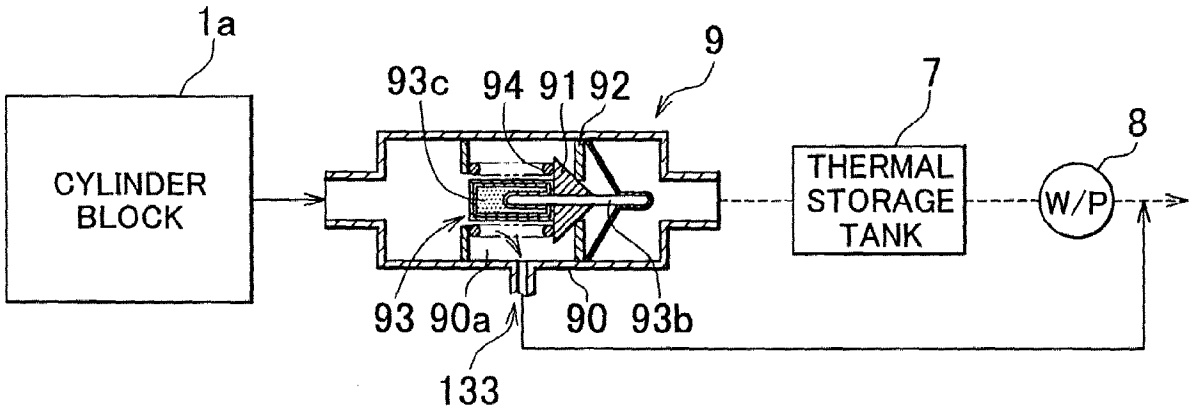
FIG. 7A and FIG. 7B are diagrams showing other embodiments of the cooling system according to the invention.

In the structure shown in FIG. 7A, a pipe 133 is provided such that one end thereof is connected to a flow passage 90*a* in the area where the temperature-sensing portion 93 is provided in the housing 90 of the check valve 9 and the other end is connected to a coolant passage provided on the inlet port side of the electrically-driven water pump 8 (i.e., the return pipe 122 of the heater core 5). According to this structure, a certain amount of coolant flows in the following order: the cylinder block 1*a*→the periphery of the temperature-sensing portion 93 in the check valve 9→the pipe 133→the inlet port side of the electrically-driven water pump 8. Therefore, the temperature-sensing portion 93 can be brought into contact with the coolant flowing from the cylinder block 1*a*.

Figure 7B:
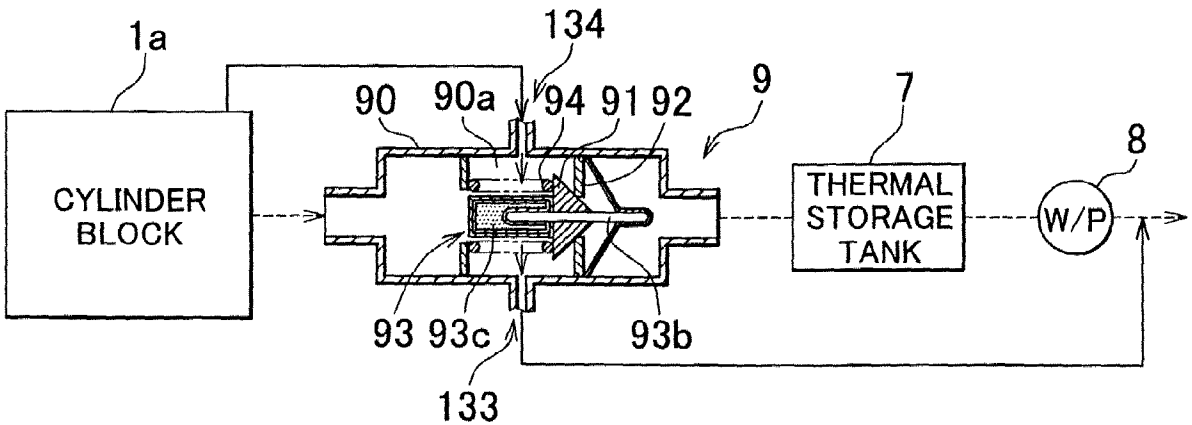
Figure 8:
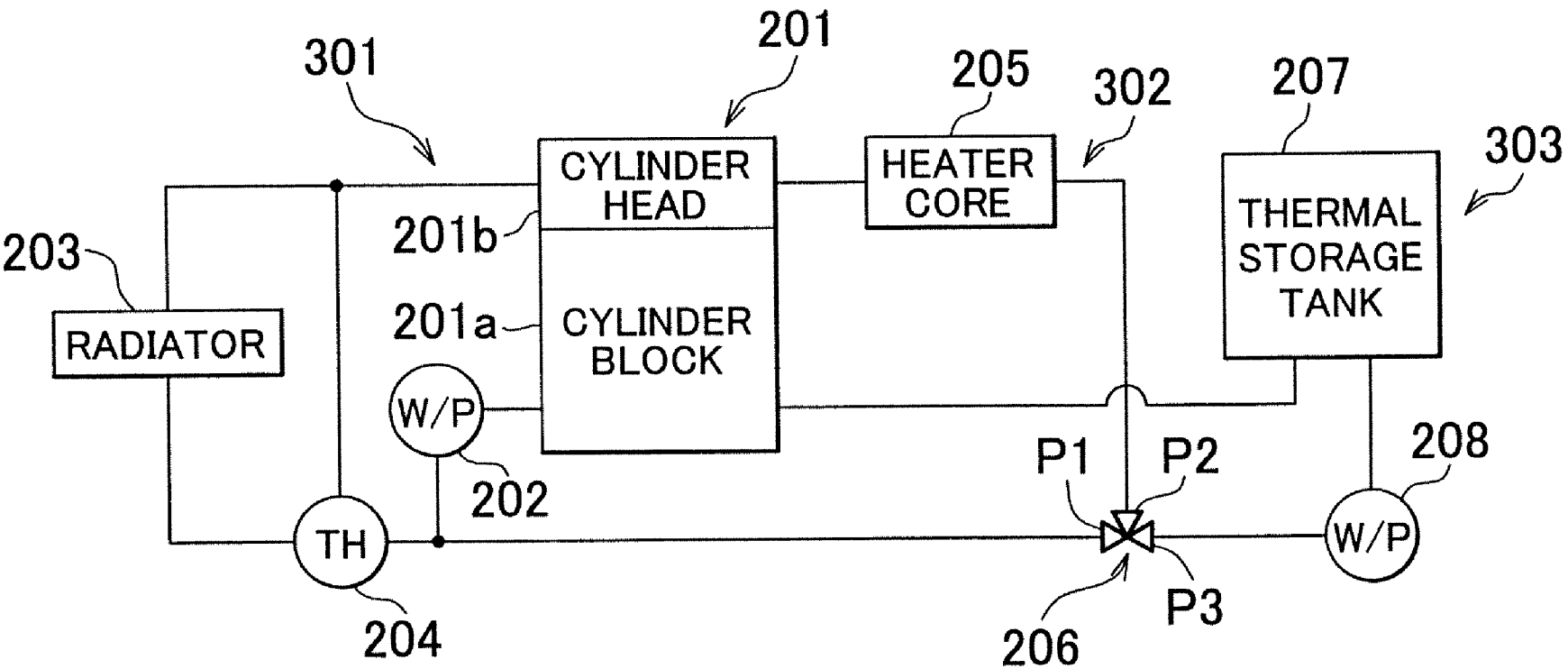
FIG. 8 Related Art
FIG. 8 is a circuit diagram showing one example of a cooling system according to a related art.

In the structure shown in FIG. 7B, in addition to the pipe 133 in FIG. 7A, a pipe 134 is provided such that one end thereof is connected to the flow passage 90*a*, arranged in the area where the temperature-sensing portion 93 is provided, in the housing 90 of the check valve 9 and the other end is connected to the cylinder block 1*a*. In this structure, the pipe 134 is provided exclusively for directly introducing a portion of the coolant from the cylinder block 1*a* to the temperature-sensing portion 93 of the check valve 9. Therefore, compared to the structures shown in FIG. 6B and FIG. 7A, warm coolant having a higher temperature is brought into contact with the temperature-sensing portion 93 of the check valve 9. Thus, it is possible to improve the response of the check valve 9 to an increase and a decrease in the coolant temperature.

It should be noted that, in the above-described embodiments, the valve body 91 of the check valve 9 is displaced by the expansion and contraction of the thermowax 93*c* in the temperature-sensing portion 93 of the check valve 9, however the invention is not limited to this. For example, other materials such as bimetal, shape-memory alloy (or shape-memory resin), which changes form in response the temperature of its surroundings, may be used to enable displacement of the valve body 91 of the check valve 9.

What is claimed is:

1. A cooling device of an internal combustion engine, comprising:

a thermal storage device that stores a portion of a coolant that circulates in an internal combustion engine and that keeps the stored coolant warm; and a valve device that is provided between the thermal storage device and the internal combustion engine and controls the flow of the coolant, the valve device including a first port in fluid communication with the internal combustion engine and a second port in fluid communication with the thermal storage device, wherein the valve device restricts the flow of the coolant from the first port to the second port and allows flow from the second port to the first port at a first coolant temperature, and wherein the valve device loosens the restriction on the flow of the coolant from the first port to the second port when the temperature of the coolant increases to a second coolant temperature that is higher than the first coolant temperature.

2. The cooling device of an internal combustion engine according to claim 1, wherein the valve device includes a temperature-sensing portion that opens a valve body of the valve device when the temperature of the coolant in contact with the temperature-sensing portion increases, thereby reducing the restriction on the flow of the coolant.

3. The cooling device of an internal combustion engine according to claim 2, wherein the valve body is opened by a displacement of the valve body itself, the displacement being caused by a expansion of the temperature-sensing portion in response to an increase in the temperature of the coolant in contact with the temperature-sensing portion.

4. The cooling device of an internal combustion engine according to claim 2, wherein the valve device is structured to bring the temperature-sensing portion into contact with the coolant flowing from the internal combustion engine by diverting the coolant within the valve device when the valve device is restricting the flow of the coolant.

5. The cooling device of an internal combustion engine according to claim 2, wherein a pipe, which communicates with a flow passage within the valve device where the temperature-sensing portion is located, is provided through which the coolant flows when the valve device restricts the flow of the coolant, to bring the temperature-sensing portion into contact with the coolant flowing from the internal combustion engine.

6. The cooling device of an internal combustion engine according to claim 2, further comprising:

a radiator; and a thermostat that controls a flow rate of coolant between the internal combustion engine and the radiator, wherein the thermostat switches to allow the coolant to flow to the radiator at a thermostat switching temperature which is higher than a valve body opening temperature at which the valve body of the valve device opens to loosen the restriction on the flow of the coolant from the first port to the second port.

7. The cooling device of an internal combustion engine according to claim 2, wherein the valve device includes a restricting portion that restricts the flow of the coolant from the first port to the second port and allows flow from the second port to the first port at a first coolant temperature, the restricting portion being located between the first port and the second port, a flow passage in a portion of the valve device that includes the temperature-sensing portion, the flow passage being located in the valve device between the restricting portion and the first port, and a third port in fluid communication with the flow passage and a coolant passage located on a thermal storage tank side of the valve device.

8. The cooling device of an internal combustion engine according to claim 2, wherein the valve device includes a fourth port in fluid communication with the flow passage and the internal combustion engine.

9. The cooling device of an internal combustion engine according to claim 2, wherein the valve device contacts a main body of the internal combustion engine.

10. The cooling device of an internal combustion engine according to claim 9, wherein the valve device is incorporated in the main body of the internal combustion engine.

11. The cooling device of an internal combustion engine according to claim 9, wherein the valve device is disposed outside of the main body of the internal combustion engine.

12. The cooling device of an internal combustion engine according to claim 1, wherein the valve device includes a valve seat plate between the first port and the second port, and wherein valve seat plate includes a leak portion that allows the coolant to flow from the first port to the second port at the first coolant temperature.

13. The cooling device of an internal combustion engine according to claim 12, wherein the leak portion includes a notch in the valve seat plate.

14. The cooling device of an internal combustion engine according to claim 12, wherein the leak portion includes a through hole in the valve seat plate that is distinct from a valve body through hole that engages a valve body of the valve device when the valve device restricts the flow of coolant from the first port to the second port.

15. The cooling device of an internal combustion engine according to claim 1, wherein the valve device is a check valve that substantially prevents flow of the coolant from the first port to the second port at the first temperature.

16. The cooling device of an internal combustion engine according to claim 1, further comprising a heater core, wherein the valve device is not in direct fluid communication with the heater core.

* * * * *